US009057176B2

(12) United States Patent
Renski

(10) Patent No.: US 9,057,176 B2
(45) Date of Patent: Jun. 16, 2015

(54) RETENTION SYSTEM FOR A GROUND-ENGAGING TOOL

(75) Inventor: William J. Renski, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 329 days.

(21) Appl. No.: 13/535,241

(22) Filed: Jun. 27, 2012

(65) Prior Publication Data

US 2013/0000162 A1 Jan. 3, 2013

Related U.S. Application Data

(60) Provisional application No. 61/502,277, filed on Jun. 28, 2011.

(51) Int. Cl.
*E02F 9/28* (2006.01)

(52) U.S. Cl.
CPC ..... *E02F 9/2833* (2013.01)

(58) Field of Classification Search
CPC ..... E02F 9/2833; E02F 9/2858; E02F 9/2816; E02F 9/2883
USPC ..... 37/455, 456, 457
See application file for complete search history.

(56) References Cited

U.S. PATENT DOCUMENTS

| | | | | |
|---|---|---|---|---|
| 1,690,834 | A | 11/1928 | Ratkowski | |
| 1,722,154 | A * | 7/1929 | Meyer | 37/456 |
| 1,808,311 | A | 6/1931 | Madonna | |
| 1,998,116 | A * | 4/1935 | Bone | 411/398 |
| 2,064,059 | A * | 12/1936 | Fellmeth | 37/456 |
| 2,379,472 | A | 7/1945 | Bowman | |
| 2,427,651 | A | 9/1947 | Baer | |
| 2,895,559 | A | 7/1959 | Toland | |
| 3,197,894 | A | 8/1965 | Ratkowski | |
| 3,312,004 | A | 4/1967 | Johnson | |
| 3,453,756 | A | 7/1969 | Schroeder | |
| 3,751,834 | A | 8/1973 | Petersen | |
| 3,753,582 | A | 8/1973 | Graham | |
| 3,909,888 | A | 10/1975 | Funston et al. | |
| 4,505,058 | A | 3/1985 | Peterson | |
| 5,423,138 | A | 6/1995 | Livesay et al. | |
| 5,435,084 | A | 7/1995 | Immel | |
| 5,561,925 | A | 10/1996 | Livesay | |
| 5,709,043 | A | 1/1998 | Jones et al. | |

(Continued)

FOREIGN PATENT DOCUMENTS

| | | |
|---|---|---|
| EP | 0 203 315 A2 | 12/1986 |
| EP | 1 626 132 A2 | 2/2006 |

(Continued)

*Primary Examiner* — Jamie L McGowan
(74) *Attorney, Agent, or Firm* — Finnegan, Henderson, Farabow, Garrett & Dunner, LLP

(57) ABSTRACT

A retention system for a ground-engaging tool includes a pin. The pin may include a shaft extending along a longitudinal axis of the pin; a radial projection extending from a first end of the shaft; and a head disposed at a second end of the shaft, the head having a non-circular axial cross-section. The system may also include a retainer collar. The collar may include an annular wall surrounding a recess configured to receive the first end of the shaft; an axial slot in an inner surface of the annular wall, the axial slot extending from a first end of the annular wall inward and being configured to receive the radial projection; and a circumferential slot connected to the axial slot in the inner surface of the annular wall, the circumferential slot being configured to receive the radial projection of the pin.

11 Claims, 5 Drawing Sheets

(56) References Cited

U.S. PATENT DOCUMENTS

| | | | | |
|---|---|---|---|---|
| 5,913,605 | A | 6/1999 | Jusselin et al. | |
| 5,992,063 | A * | 11/1999 | Mack | 37/450 |
| 6,757,995 | B2 * | 7/2004 | Pippins | 37/468 |
| 6,799,386 | B2 | 10/2004 | Robinson et al. | |
| 6,976,325 | B2 | 12/2005 | Robinson et al. | |
| 7,036,249 | B2 * | 5/2006 | Mautino | 37/457 |
| 7,069,676 | B2 | 7/2006 | Robinson et al. | |
| 7,121,023 | B2 | 10/2006 | Robinson et al. | |
| 7,313,877 | B2 | 1/2008 | Clendenning et al. | |
| 7,603,799 | B2 | 10/2009 | Campomanes | |
| 7,640,685 | B2 | 1/2010 | Emrich | |
| 7,681,341 | B2 | 3/2010 | Ruvang | |
| 7,690,137 | B2 | 4/2010 | Pasqualini | |
| 7,730,651 | B2 | 6/2010 | Carpenter | |
| 7,788,830 | B2 | 9/2010 | Woerman et al. | |
| RE41,855 | E | 10/2010 | Ruvang et al. | |
| 7,874,086 | B2 | 1/2011 | Briscoe et al. | |
| D634,605 | S * | 3/2011 | Guimaraes | D8/343 |
| 7,926,207 | B2 * | 4/2011 | Lopez Almendros et al. | 37/452 |
| 8,434,248 | B2 * | 5/2013 | Woerman et al. | 37/456 |
| 2003/0070330 | A1 | 4/2003 | Olds et al. | |
| 2004/0016153 | A1 * | 1/2004 | Pippins | 37/456 |
| 2004/0118021 | A1 | 6/2004 | Renski | |
| 2004/0139632 | A1 * | 7/2004 | Robinson et al. | 37/456 |
| 2006/0037219 | A1 * | 2/2006 | Robinson et al. | 37/456 |
| 2006/0127239 | A1 | 6/2006 | Adamic et al. | |
| 2009/0174252 | A1 | 7/2009 | Morris et al. | |
| 2010/0162594 | A1 | 7/2010 | Bierwith | |
| 2010/0162595 | A1 * | 7/2010 | Leslie et al. | 37/456 |
| 2010/0170119 | A1 * | 7/2010 | Lopez Almendros et al. | 37/452 |
| 2012/0304508 | A1 * | 12/2012 | Guimaraes et al. | 37/457 |
| 2013/0185965 | A1 * | 7/2013 | Bartolome Rodriguez | 37/453 |
| 2014/0075793 | A1 * | 3/2014 | Lopez Almendros et al. | 37/456 |

FOREIGN PATENT DOCUMENTS

| | | | |
|---|---|---|---|
| GB | 886215 | | 1/1962 |
| RU | 2067696 | C1 | 10/1996 |
| WO | WO 2004/029371 | A1 | 4/2004 |
| WO | WO 2009/059385 | A1 | 5/2009 |
| WO | WO 2009/020175 | A1 | 12/2009 |
| WO | WO 2010/048203 | A1 | 4/2010 |

* cited by examiner

RETENTION SYSTEM FOR A GROUND-ENGAGING TOOL

RELATED APPLICATIONS

This application is based on and claims the benefit of priority from U.S. Provisional Application No. 61/502,277 by Renski, filed Jun. 28, 2011, the contents of which are expressly incorporated herein by reference.

TECHNICAL FIELD

The present disclosure relates to ground-engaging tools and, more particularly, to retention systems for ground-engaging tools.

BACKGROUND

Many machines include ground-engaging tools for performing operations like digging, excavating, and tilling. For example, many machines include an excavating bucket with ground-engaging teeth attached to an edge of the bucket. Ground-engaging tools, like the teeth attached to such a bucket, may experience substantial wear in use. Because of such wear, ground-engaging tools like bucket teeth may require occasional replacement. Accordingly, ground-engaging tools are often secured to a machine with a retention system that allows for readily removing the ground-engaging tool for replacement.

For example, Published U.S. Patent Application No. 2003/0070330 to Olds et al. ("the '330 application") discloses a retention system for detachably securing an excavation tooth to a machine. The retention system disclosed by the '330 application includes an adapter to which the excavation tooth mounts. The retention system also includes a pin configured to detachably engage openings in the adapter and the excavation tooth to hold the excavation tooth in place. To detachably secure the pin to the excavation tooth, the retention system includes a projection on the pin and slots integrally formed in the excavation tooth to receive the projection of the pin.

Although the '330 application discloses a retention system for detachably securing an excavation tooth to an adapter, certain disadvantages may persist. For example, because the slots for engaging the projection of the pin are integrally formed in the excavation tooth, repairing the retention system may prove difficult or expensive if these slots should become damaged or plugged.

The disclosed embodiments may solve one or more of the foregoing problems.

SUMMARY

One disclosed embodiment relates to a retention system for a ground-engaging tool. The retention system may include a pin. The pin may include a shaft extending along a longitudinal axis of the pin. The pin may also include a radial projection extending from a first end of the shaft. Additionally, the pin may include a head disposed at a second end of the shaft, the head having a non-circular axial cross-section. The retention system may also include a retainer collar. The retainer collar may include an annular wall surrounding a recess configured to receive the first end of the shaft. The retainer collar may also include an axial slot in an inner surface of the annular wall, the axial slot extending from a first end of the annular wall inward. The axial slot may be configured to receive the radial projection. The retainer collar may also include a circumferential slot connected to the axial slot in the inner surface of the annular wall, the circumferential slot being configured to receive the radial projection of the pin.

Another embodiment relates to a pin for a retention system of a ground-engaging tool. The pin may include a shaft extending along a longitudinal axis of the pin, wherein a first end of the shaft has a substantially circular axial cross-section. The pin may also include a stud projecting radially from the first end of the shaft. Additionally, the pin may include a head extending from a second end of the shaft, the head having a non-circular axial cross-section.

A further embodiment relates to a retainer collar for a retention system of a ground-engaging tool. The retainer collar may include an annular wall surrounding a substantially circular recess, the annular wall including a first axial end and a second axial end. The retainer collar may also include an axial slot in an inner surface of the annular wall, the axial slot extending from the first axial end of the annular wall to a point between the first and second axial ends. Additionally, the retainer collar may include a circumferential slot in the inner surface of the annular wall, the circumferential slot connecting to the axial slot. The retainer collar may also include a tool interface connected to the second axial end of the annular wall.

DETAILED DESCRIPTION

Figure 1:
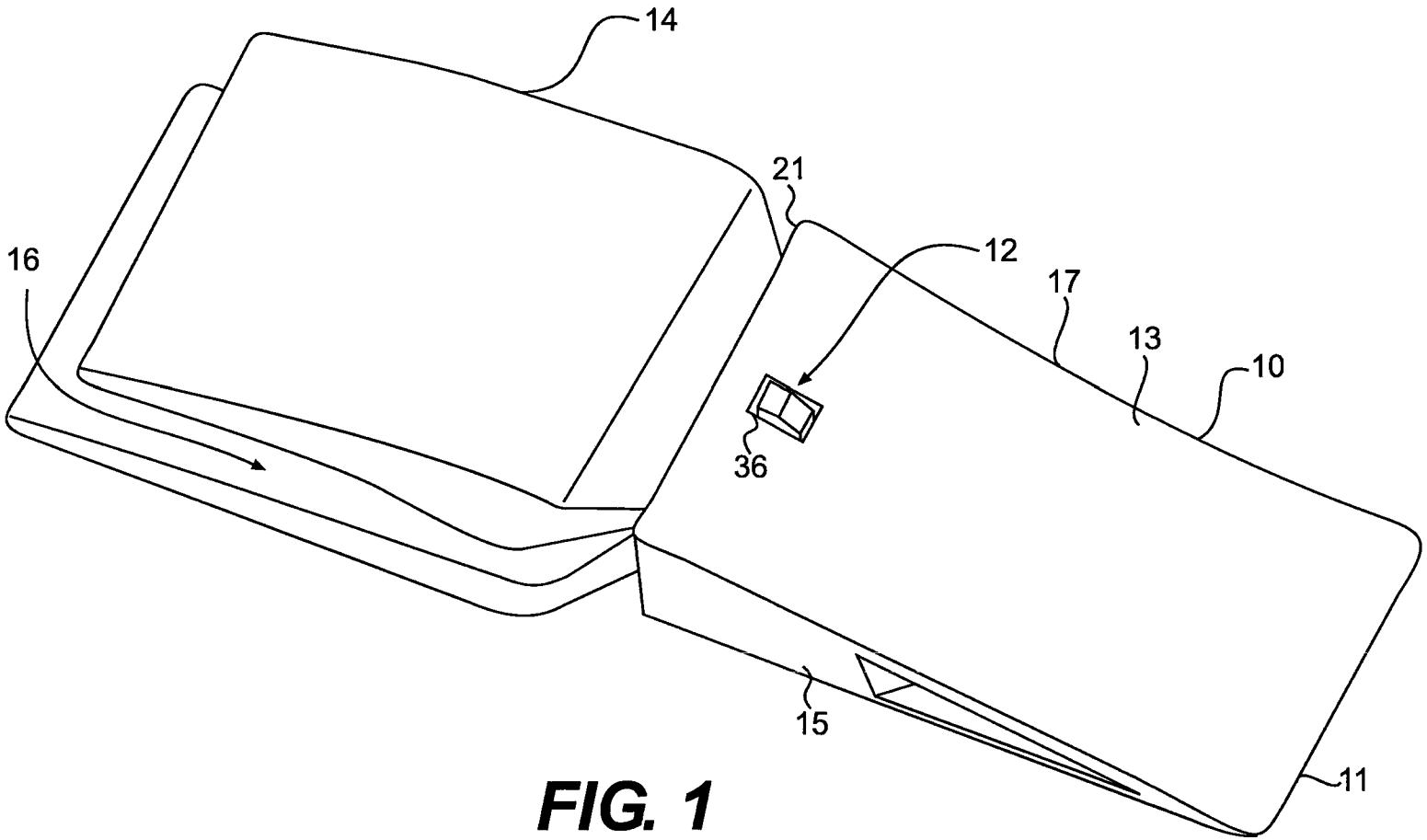
FIG. 1 is a perspective view of one embodiment of a ground-engaging tool attached to an adapter by a retention system according to the present disclosure.
Figure 2:
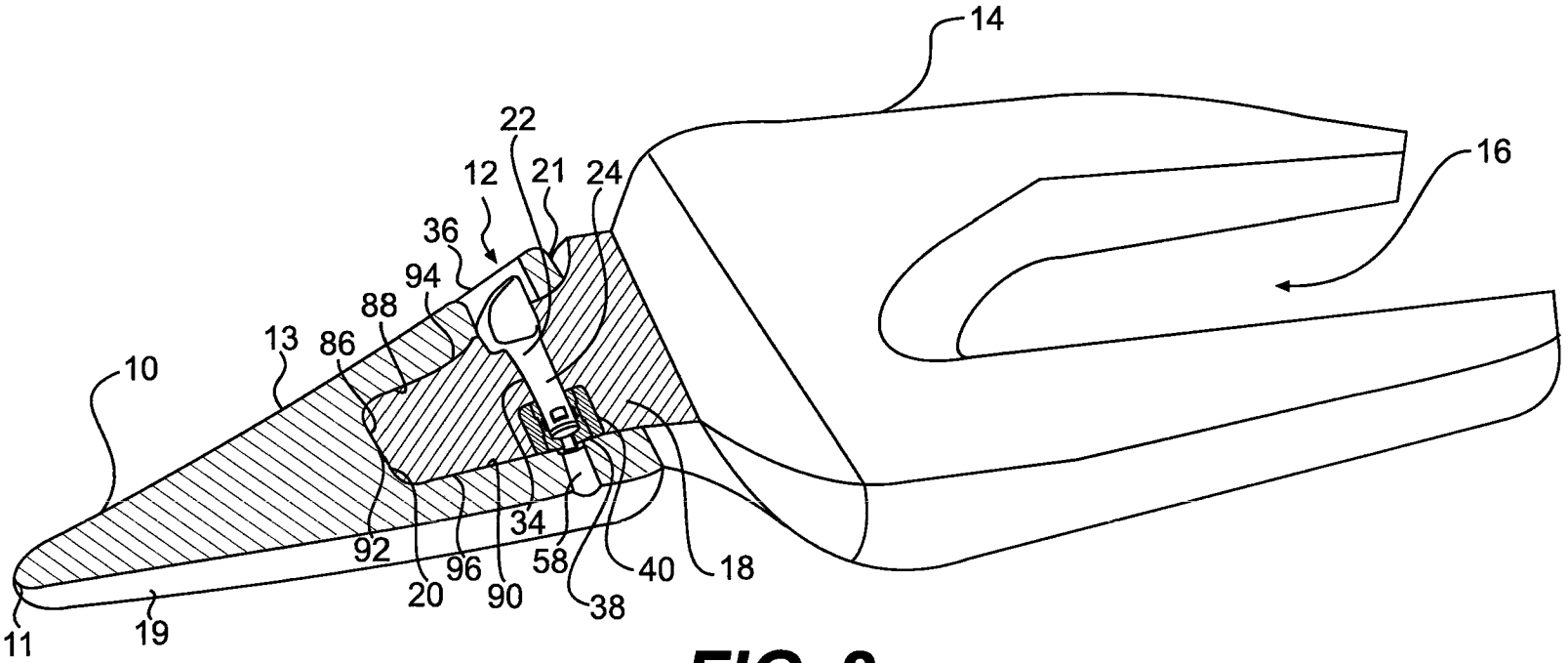
FIG. 2 is a side view of the components shown in FIG. 1 partially in section.
Figure 3:
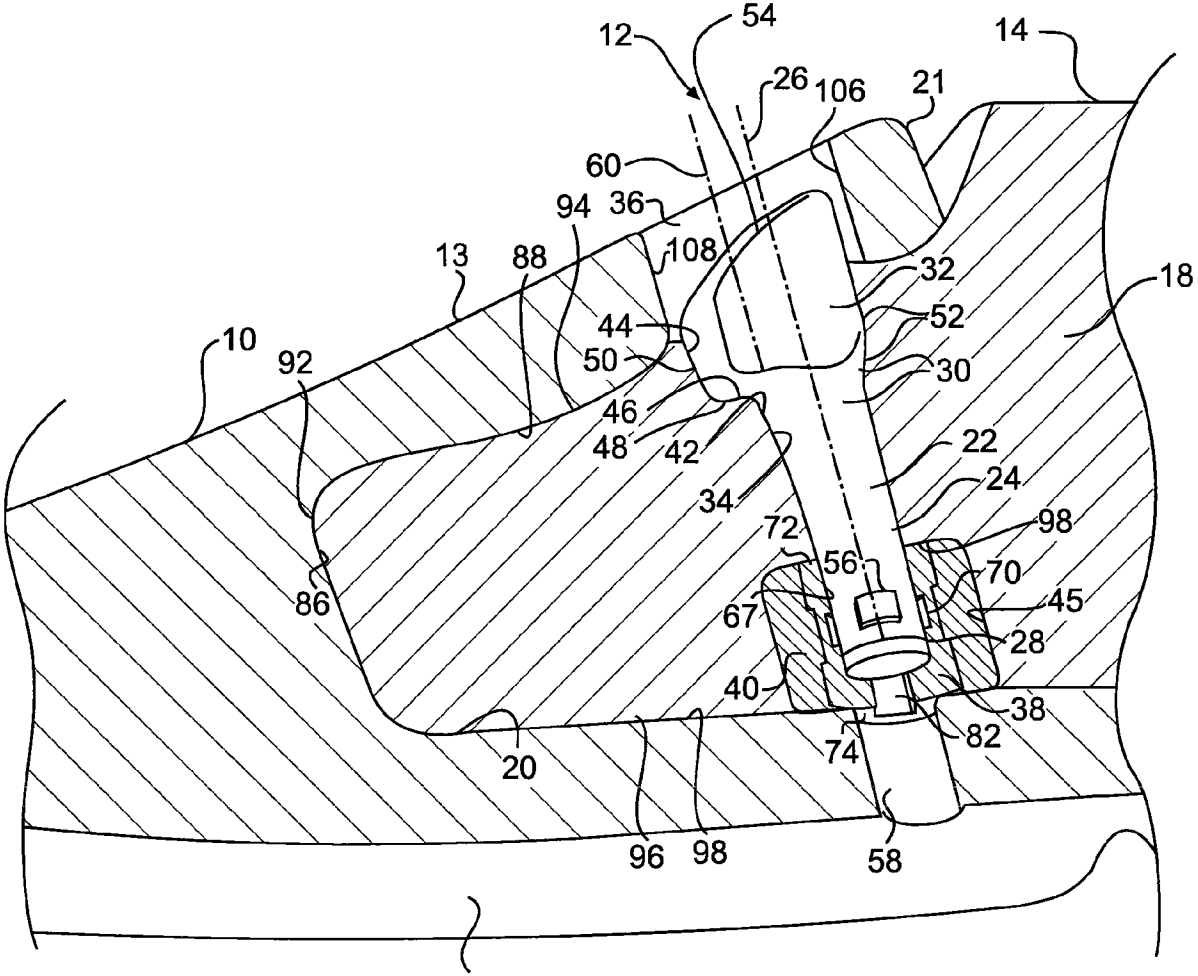
FIG. 3 is an enlarged view of a portion of FIG. 2.

FIGS. 1-5 illustrate one embodiment according to the present disclosure of a ground-engaging tool 10 and a retention system 12 for retaining the ground-engaging tool 10 on another component, such as an adapter 14. Ground-engaging tool 10 may be any component configured to penetrate the ground or similar substances during operations such as earth moving, tillage, material loading, and the like. For example, as shown in FIGS. 1-3, ground-engaging tool 10 may be a tooth for penetrating soil or the like in an earthmoving or tillage operation. Ground-engaging tool 10 may include a front edge 11, a top wall 13, side walls 15, 17, a bottom wall 19, and a rear surface 21. Top wall 13 and bottom wall 19 may diverge as they extend away from front edge 11.

Retention system 12 may secure ground-engaging tool 10 to various types of components. In the example shown in FIGS. 1-4, retention system 12 may secure ground-engaging tool 10 to an adapter 14 configured to mount to an edge of an earthmoving component, such as a bucket of an excavator. As best shown in FIG. 2, adapter 14 may include a slot 16 for receiving the edge of a bucket or other type of earthmoving component. Thus, adapter 14 may be secured to the edge of a bucket by placing the edge in slot 16 and fastening it there, such as by welding adapter 14 to the edge. As also shown in FIG. 2, adapter 14 may include a nose 18 projecting forward, and ground-engaging tool 10 may include a pocket 20 configured to mate with nose 18 of adapter 14. Pocket 20 may be formed inward of rear surface 21 between top wall 13, bottom wall 19, and side walls 15, 17. Pocket 20 may have substantially the same shape as nose 18 of adapter 14. As best shown in FIGS. 2 and 3, pocket 20 may include a front surface 86, a top surface 88, and a bottom surface 90. Nose 18 of adapter 14 may include a front surface 92, atop surface 94, and a bottom surface 96 that mate with front surface 86, top surface 88, and bottom surface 90, respectively, of pocket 20. In some embodiments, top surface 94 of nose 18 may slope toward bottom surface 96 as top surface 94 extends toward front surface 92. Pocket 20 and nose 18 of adapter 14 may also include side surfaces (not shown) that mate with one another.

Figure 4:
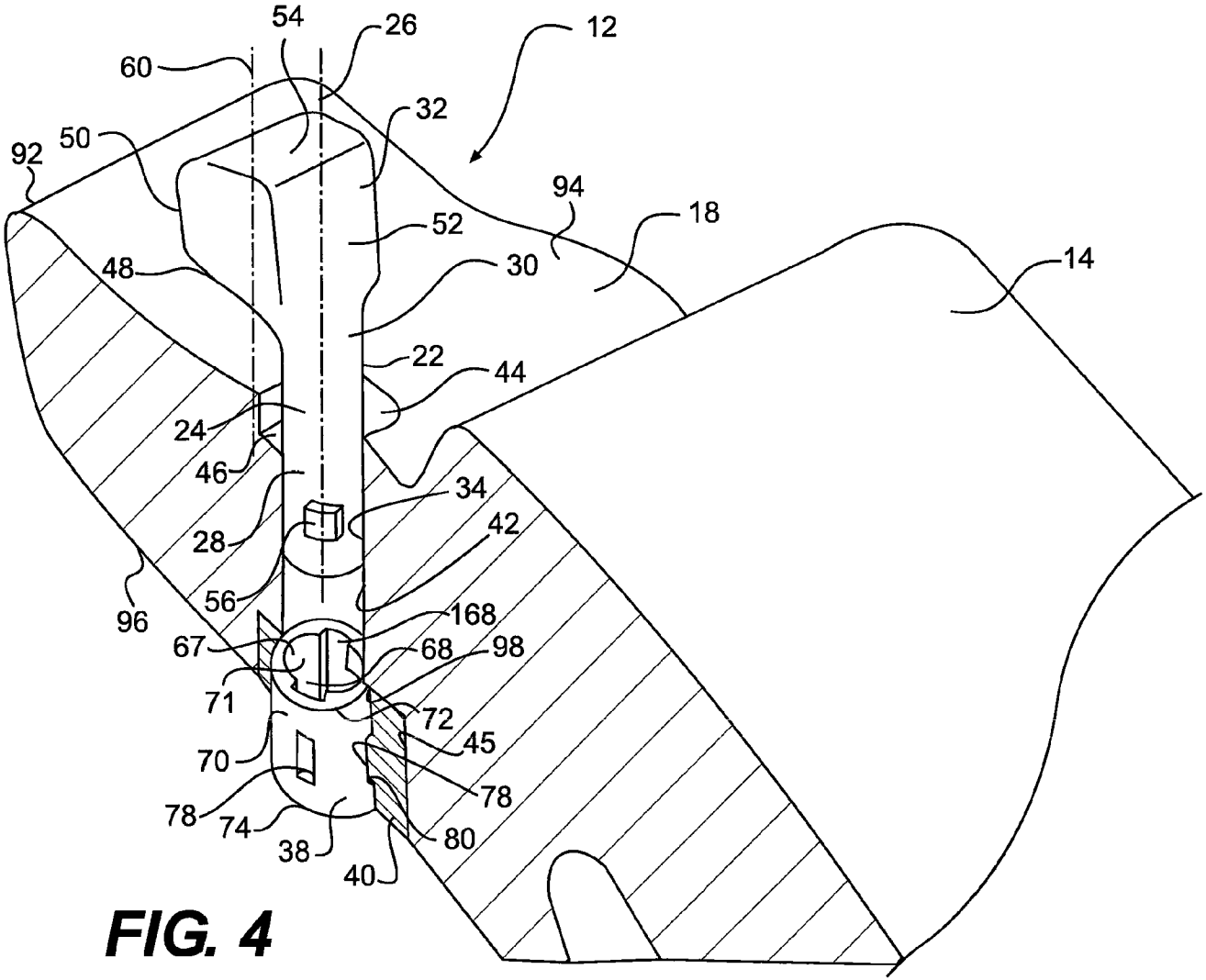
FIG. 4 is a perspective view of the components of FIG. 1 from a different angle and with the ground-engaging tool omitted.

As best shown in FIG. 3, retention system 12 may include a pin 22 that extends through openings in adapter 14 and ground-engaging tool 10 to hold ground-engaging tool 10 on adapter 14. Pin 22 may include a shaft 24 extending along a longitudinal axis 26 of pin 22. Shaft 24 may include a first end 28 and a second end 30. Pin 22 may include a head 32 extending from second end 30 of shaft 24. Head 32 may have a different axial cross-section than shaft 24. As used herein, the term "axial cross-section" refers to a cross-section perpendicular to longitudinal axis 26. As best shown in FIG. 4, shaft 24 may have a round axial cross-section, and head 32 may have a non-round axial cross-section. For example, shaft 24 may have a substantially circular axial cross-section, and head 32 may have a substantially rectangular axial cross-section. Additionally, head 32 may have a larger axial cross-section than shaft 24.

In some embodiments, head 32 of pin 22 may be offset radially relative to shaft 24. For example, as best shown in FIG. 3, an axis 60 of head 32 may be radially offset relative to axis 26 of shaft 24. Thus, a side 50 of head 32 may be further from axis 26 than an opposing side 52 of head 32. In some embodiments, side 52 may extend substantially even with an outer surface of shaft 24. This may avoid the presence of stress concentrations between head 32 and shaft 24. Extending between shaft 24 and side 50, head 32 may include a shoulder 48 facing in the direction that shaft 24 extends away from head 32.

To receive pin 22, adapter 14 may have a passage 34, and ground-engaging tool 10 may have an opening 36 that substantially aligns with passage 34 when ground-engaging tool 10 is properly positioned on adapter 14. In some embodiments, opening 36 may be formed in top wall 13 of ground-engaging tool 10. Opening 36 may have cross-sectional shape and size that allows pin 22 to pass through opening 36. As best shown in FIG. 4, passage 34 may include an inner portion 42 for receiving shaft 24 of pin 22 and a first outer portion 44 for receiving head 32 of pin 22. The axial cross-sectional shapes of inner and outer portions 42, 44 of passage 34 may correspond to the axial cross-sections of shaft 24 and head 32, respectively of pin 22. For example, inner portion 42 of passage 34 may have a round cross-section slightly larger than the round cross-section of shaft 24. Similarly, first outer portion 44 may have a substantially rectangular axial cross-section slightly larger than the cross-section of head 32. Additionally, first outer portion 44 of passage 34 may be offset relative to inner portion 42 by substantially the same amount that axis 60 of head 32 is offset from axis 26 of shaft 24. A step between inner portion 42 and first outer portion 44 may provide a shoulder 46 against which shoulder 48 of head 32 may rest.

Engagement between head 32 of pin 22 and first outer portion 44 of passage 34 may restrain movement of pin 22 in multiple directions. For example, engagement between the non-circular axial cross-section of pin 32 and the mating non-circular axial cross-section of first outer portion 44 of passage 34 may prevent pin 22 from rotating about longitudinal axis 26. Additionally, abutment between shoulders 46, 48 may restrain pin 22 from moving out of passage 34 in the direction that shaft 24 extends from head 32. First outer portion 44 of passage 34 may have a depth such that at least a portion of head 32 extends outward of passage 34 when shoulder 48 of head 32 rests on shoulder 46. As noted above, in some embodiments, top surface 94 of nose 18 may slope downward as it extends toward front surface 92 of nose 18. As a result, the rear of first outer portion 44 of passage 34 may be deeper than the front of first outer portion 44. Head 32 may have a complementary shape. For example, side surface 52 of head 32 may be longer and extend farther away from shaft 24 than side surface 50. Accordingly, an end 54 of head 32 may slope toward first end 28 of shaft 24 as it extends from an outer end of side surface 52 to an outer end of side surface 50.

As noted above, opening 36 in top surface 13 of ground-engaging tool 10 may have a size and shape that allows pin 22 to pass through opening 36. In some embodiments, opening 36 may have a shape similar to, but slightly larger than, the axial cross-section of head 32 of pin 22. For example, where head 32 has a rectangular axial cross-section, opening 36 may have a slightly larger rectangular cross-section. Accordingly, as best shown in FIG. 3, when pin 22 is disposed in passage 34 with ground-engaging tool 10 secured to adapter 14, a rear surface 106 of opening 36 may be disposed in close proximity to side 52 of head 32, and a forward surface 108 may be disposed in close proximity to a side 50 of head 32. In some embodiments, nose 18 of adapter 14, and ground-engaging tool 10 may be configured in such a manner that some gap may exist between rear surface 106 of opening 36 and side 52 of head 32 in some circumstances. For example, as shown in FIG. 3, when ground-engaging tool 10 is positioned on nose 18 of adapter 14 with front surface 86 of pocket 20 contacting front surface 92 of nose 18, a gap may exist between rear surface 106 of opening 36 and side 52 of head 32. On the other hand, if ground-engaging tool 10 slides forward on nose 18 (i.e., in the direction that front edge 11 faces), rear surface 106 may contact side 52 of head 32, and a gap may open between front surface 86 of pocket 20 and front surface 92 of nose 18. As FIG. 3 also shows, opening 36 may have a depth such that end surface 54 of head 32 is disposed inward of an outer surface of top wall 13 when pin 22 is disposed in passage 34.

As shown in FIGS. 2-5, to restrain pin 32 from sliding out of passage 34 in the direction that head 32 extends away from shaft 24, retention system 12 may include a retainer collar 38 and holder 40 for engagement to first end 28 of shaft 24. To accommodate retainer collar 38 and holder 40, passage 34 may include a second outer portion 45, opposite first outer portion 44. Second outer portion 45 may have an axial cross-section larger than inner portion 42. In some embodiments, second outer portion 45 may have a round axial cross-section, such as a circular axial cross-section. A step between inner portion 42 and second outer portion 45 of passage 34 may form a shoulder 98 facing away from inner portion 42.

Figure 5:
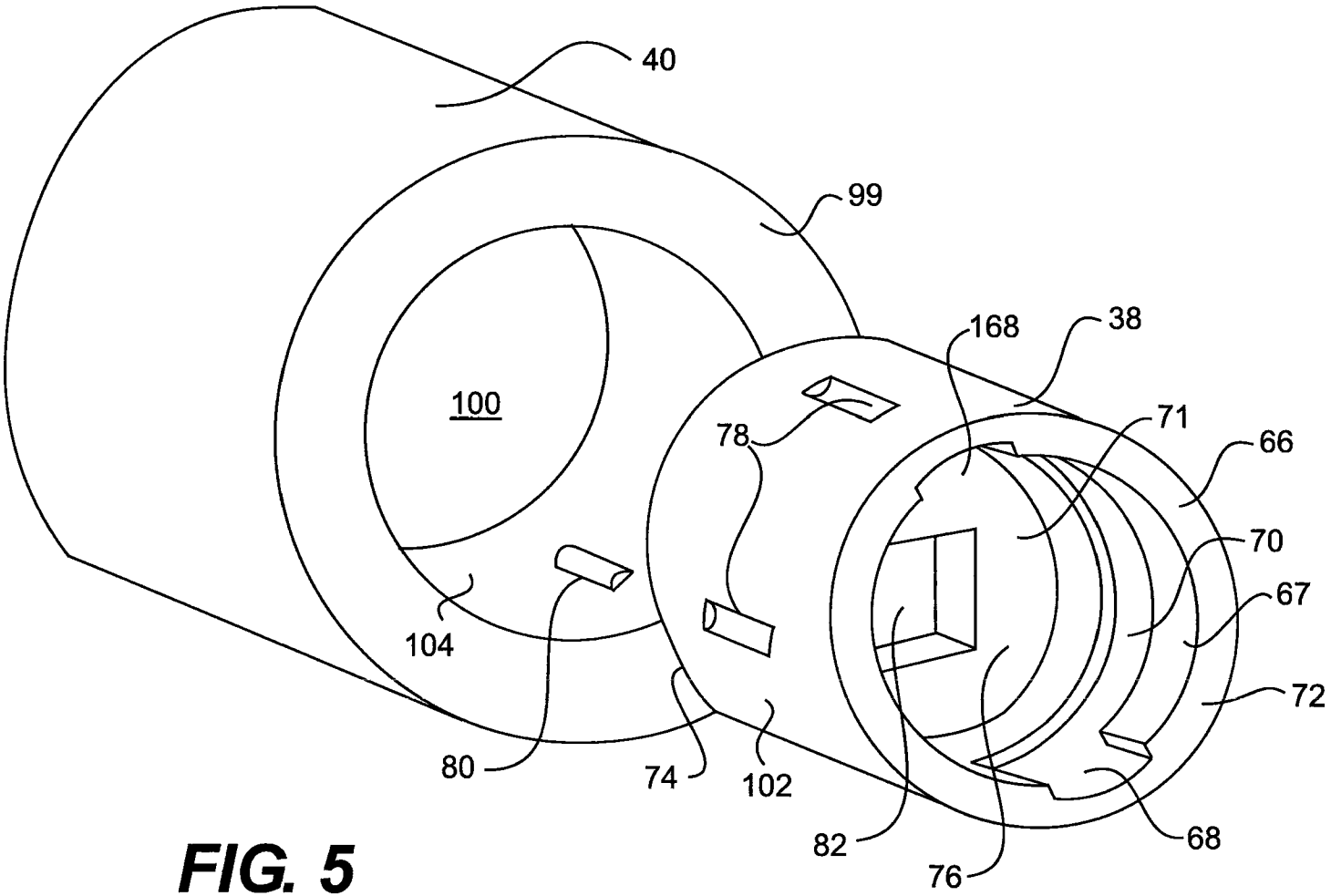
FIG. 5 is a perspective view of one embodiment of a retainer collar and a holder according to the present disclosure.

As best shown in FIG. 5, retainer collar 38 may include an annular wall 66 with an outer surface 102 and an inner surface 67 surrounding a recess 71. Annular wall 66 may include a first axial end 72 and a second axial end 74. Outer surface 102 of retainer collar 38 may have various configurations. As FIG. 5 shows, in some embodiments, outer surface 102 may be a generally cylindrical surface. Recess 71 may be configured to receive first end 28 of shaft 24. Recess 71 may have an axial cross-section of generally the same shape but slightly larger than first end 28 of shaft 24. For example, where first end 28 has a substantially circular axial cross-section, recess 71 may have a slightly larger substantially circular axial cross-section.

Retainer collar 38 and first end 28 of shaft 24 may include provisions for securing retainer collar 38 to shaft 24. As best shown in FIGS. 4 and 5, inner surface 67 of annular wall 66 may include an axial slot 68 extending inward from axial end 72, as well as a circumferential slot 70 extending from an inner end of axial slot 68. Axial slot 68 may extend partway from first axial end 72 toward second axial end 74, such that the inner end of axial slot 68 may be disposed between first axial end 72 and second axial end 74. Similarly, circumferential slot 70 may extend partway around inner surface 67 of annular wall 66.

As best shown in FIG. 4, to mate with axial slot 68 and circumferential slot 70, first end 28 of shaft 24 may include a radial projection, such as a stud 56. Axial slot 68, circumferential slot 70, and stud 56 may have shapes and sizes such that stud 56 can slide axially within axial slot 68 and circumferentially within circumferential slot 70. For example, in some embodiments, axial slot 68 and circumferential slot 70 may have substantially rectangular cross-sections, and stud 56 may have a slightly smaller substantially rectangular cross-section. Accordingly, stud 56 may be slid axially into axial slot 68 adjacent first axial end 72, slid axially to the inner end of axial slot 68, and then slid circumferentially from the inner end of axial slot 68 into circumferential slot 70. Such sliding of stud 56 within slots 68, 70 may be accomplished by moving retainer collar 38. When stud 56 is disposed within circumferential slot 70 at a position not aligned with axial slot 68, abutment between stud 56 and the walls of circumferential slot 70 may prevent relative movement between retainer collar 38 and pin 22 in the direction of axis 26.

In some embodiments, pin 22 may have a plurality of radial projections like stud 56 disposed at different circumferential positions around shaft 24. To mate with these, retainer collar 38 may have multiple corresponding sets of axial and circumferential slots like axial slot 68 and circumferential slot 70 at corresponding positions around inner surface 67 of annular wall 66. For example, as FIG. 4 shows, retainer collar may include one additional axial slot 168 that extends to an additional circumferential slot (not shown). To mate with this additional axial slot 168 and the corresponding circumferential slot, pin 22 may include one additional stud (not shown) on first end 28 of shaft 24. Alternatively, retention system 12 may employ more than two instances of mating studs and slots disposed circumferentially around pin 22 and retainer collar 38. Where retention system 12 has multiple instances of mating studs and slots, various circumferential spacing may be used between each of the instances of the mating features. In some embodiments, the mating features may be positioned at equal circumferential intervals. For example, as shown in FIGS. 4 and 5, axial slots 68 and 168 may be spaced approximately 180 degrees apart. Accordingly, stud 56 and the other stud (not shown) of pin 22 may be spaced 180 degrees apart as well. Alternatively, pin 22 and retainer collar 38 may have their mating studs and slots spaced at approximately 90 degrees from one another. Furthermore, in some embodiments, the studs of pin 22 and slots of retainer collar 38 may be spaced at unequal circumferential intervals.

In some embodiments, the length of circumferential slot 70 may depend on the number of axial and circumferential slots that retainer collar 38 has for engaging studs on pin 22. For example, in embodiments where retainer collar 38 includes two sets of axial and circumferential slots to engage two studs on pin 22, circumferential slot 70 may extend 180 degrees or less around inner surface 67 to afford room for the other circumferential slot.

Retainer collar 38 may also include an end wall 76 adjacent second axial end 74 of annular wall 66. End wall 76 may include a tool interface 82 configured to engage a tool. As FIG. 5 shows, tool interface 76 may be, for example, a rectangular recess sized to receive the rectangular drive of a ratchet wrench or the like. Thus, a tool may be engaged to tool interface 82 and used to rotate retainer collar 38.

Retainer collar 38 may be constructed of various materials. In some embodiments, retainer collar 38 may be constructed of metal, such as steel, cast iron, aluminum, or another metal. Alternatively, retainer collar 38 may be constructed of other materials, such as plastic.

Holder 40 may serve to help hold retainer collar 38 within second outer portion 45 of passage 34. As best shown in FIG. 5, holder 40 may include an annular wall 99 surrounding a recess 100. Recess 100 may be configured to receive annular wall 66 of retainer collar 38. In some embodiments, recess 100 may have a cross-sectional shape and size similar to the cross-sectional shape and size of annular wall 66. For example, recess 100 may have a generally circular cross-section with a diameter similar to the outer diameter of annular wall 66. In some embodiments, the diameter of recess 100 may be slightly smaller than the outer diameter of annular wall 66. This may create an interference fit between retainer collar 38 and holder 40, which may help hold retainer collar 38 in holder 40. Similarly, annular wall 99 of retainer collar 38 may have a cross-section slightly larger than the cross-section of second outer portion 45 of passage 34. For example, annular wall 99 may have an outer diameter slightly greater than the inner diameter of second outer portion 45. This may create an interference fit between holder 40 and second outer portion 45 of passage 34, thereby helping secure holder 40 and retainer collar 38 in second outer portion 45 of passage 34.

Holder 40 may be constructed of various materials. In some embodiments, holder 40 may be constructed of a softer material than retainer collar 38 and nose 18 of adapter 14. For example, holder 40 may be constructed of a plastic, and retainer collar 38 and nose 18 of adapter 14 may be constructed of a harder metal. Constructing holder 40 of a softer material than retainer collar 38 and nose 18 of adapter 14 may facilitate assembling retainer collar 38 into holder 40 and assembling holder 40 into adapter 14 in embodiments where these components have an interference fit with one another.

In some embodiments, retainer collar 38 and holder 40 may also include mating detents for holding retainer collar 38 and holder 40 in a particular angular orientation relative to one another. On retainer collar 38, outer surface 102 may include one or more detents. For example, outer surface 102 may include recesses 78. Recesses 78 may be circumferentially spaced from one another. To mate with detents on retainer collar 38, holder 40 may include one or more detents on an inner surface 104 of annular wall 99. For example, where the retainer collar 38 includes recesses 78 in its outer surface 102, holder 40 may include one or more projections 80 (one shown) configured to mate with recesses 78.

When retainer collar 38 is disposed within recess 100 of holder 40 and one of projections 80 is mated to one of recesses 78, the engagement of the projection 80 with the recess 78 may tend to inhibit unintended rotation of retainer collar 38 within holder 40. This may tend to hold retainer collar 38 in a particular angular orientation relative to holder 40. However, if sufficient torque is applied to retainer collar 38, such as via tool interface 82, the engagement between the projection 80 and recess 78 may be broken to rotate retainer collar 38 inside holder 40. Retainer collar 38 may be rotated, for example, until a different recess 78 engages projection 80 to hold retainer collar 38 in a different angular orientation.

The detents of retainer collar 38 and/or holder 40 may have various circumferential spacing relative to one another. In some embodiments, the circumferential spacing between two detents may be less than the circumferential length of circumferential slot 70. For example, recesses 78 of retainer collar 38 may be spaced approximately 90 degrees or less from one another, and circumferential slot 70 may extend more than 90 degrees around inner surface 67 of annular wall 66. With circumferential slot 70 extending further around annular wall 66 than the spacing between adjacent detents, it may be possible to rotate retainer collar 38 an amount equivalent to the spacing between the detents while tab 56 of pin 22 is disposed within circumferential slot 70. Thus, where the spacing between the mating detents of retainer collar 38 and/or holder 40 is approximately 90 degrees or less, rotating retainer collar 38 between detents to secure pin 22 to retainer collar or to disengage pin 22 from retainer collar 38 may require only a relatively small rotation of approximately 90 degrees or less. This may facilitate easy engagement and disengagement of retention system 12 to secure ground-engaging component 10 to and disengage ground-engaging component 10 from adapter 14.

The configuration of the detents of retainer collar 38 and holder 40 may differ from the examples provided above. For instance, recesses 78 may be circumferentially spaced from one another by more or less than 90 degrees. Additionally, retainer collar 38 may omit one of recesses 78 or include more than two recesses. Furthermore, retainer collar 38 may have different configurations of detents. For example, retainer collar 38 may have one or more projections serving as detents, instead of recesses 78. In such embodiments, holder 40 may include one or more recesses for engaging the projections on outer surface 102 of retainer collar 38.

Retainer collar 38, holder 40, and second outer portion 45 of passage 34 may have various axial sizes. As best shown in FIG. 3, in some embodiments, retainer collar 38 and holder 40 may have substantially the same axial length as second outer portion 45 of passage 34. This may result in retainer collar 38 and holder 40 being substantially flush with bottom surface 96 of nose 18 when disposed within second outer portion 45 of passage 34.

To allow access to tool interface 82 of retainer collar when ground-engaging tool 10 is mounted to adapter 14, bottom wall 19 of ground-engaging tool 10 may have an opening 58 that aligns with passage 34. Opening 58 may be sized to allow a tool to extend through opening 58 without allowing retainer collar 38 or holder 40 to pass through opening 58.

Ground-engaging tool 10, retention system 12, and adapter 14 are not limited to the configurations shown in FIGS. 1-5. For example, ground-engaging tool 10 may be a type of component other than a tooth for an earthmoving bucket, such as an edge protector for a bucket or other component of an earthmoving device, a ripper, or any other type of tillage tool. Additionally, whereas the figures show opening 36 in top wall 13 and opening 58 in bottom wall 19 of ground-engaging tool 10, these openings may be located in different portions of ground-engaging tool 10. For example, opening 36 may be located in bottom wall 19, and opening 58 may be located in top wall 13. Alternatively, openings 36, 58 may be located in side walls 15, 17 of ground-engaging tool 10. Of course, in embodiments where openings 36, 58 are located in different walls of ground-engaging tool 10, passage 34 may be oriented to interact with openings 36, 58 in substantially the same manner as shown in the figures. For example, passage 34 may be flipped vertically or oriented horizontally through adapter 14, so that it has the same relationship to openings 36, 58 as shown in the figures.

INDUSTRIAL APPLICABILITY

Retention system 12 may have use wherever it is desirable to secure a ground-engaging tool 10 to a machine. The process of securing ground-engaging tool 10 to adapter 14 may begin with ground-engaging tool 10, pin 22, retainer collar 38, and holder 40 separated from one another and adapter 14. From this state, one may insert retainer collar 38 in recess 100 of holder 40, preferably with one of recesses 78 engaged to projection 80. Subsequently, one may insert holder 40 and retainer collar 38 in second outer portion 45 of passage 34 with the second axial end 72 of retainer collar 38 abutted against shoulder 98. One may then slide pocket 20 of ground-engaging component 10 onto nose 18 of adapter until ground-engaging component is substantially in the position shown in FIGS. 2 and 3. Pin 22 may then be slid through opening 36 in top surface 13 of ground-engaging component 10 into passage 34 until pin 22 is in substantially the position shown in FIGS. 2 and 3.

During this process, pin 22 may be secured to retainer collar 38 as follows. As pin 22 is slid into passage 34, stud 56 may be slid axially into axial slot 68 until stud 56 reaches the inner end of axial slot 68. This can best be visualized with reference to FIGS. 4 and 5. Once pin 22 is seated in passage 34 with stud 56 disposed at the inner end of axial slot 68 in retainer collar 38, retainer collar 38 may be rotated within holder 40 to slide circumferential slot 70 into engagement with stud 56, thereby securing first end 28 of pin 22 to retainer collar 38. Retainer collar 38 may be so rotated until one of recesses 78 engages projection 80. Retainer collar 38 may be rotated to accomplish this result by engaging a tool (not shown) to tool interface 82 in retainer collar 38 and rotating the tool. During this process, any other studs (not shown) on pin 22, may slide into engagement with corresponding axial and circumferential slots simultaneous with stud 56 sliding into engagement with axial slot 68 and circumferential slot 70.

With stud 56 disposed in circumferential slot 70, abutment between these two features may prevent axial movement of pin 22 relative to retainer collar 38. Simultaneously, abutment between first axial end 72 of retainer collar 38 and shoulder 98 may prevent upward axial movement of retainer collar 38 and pin 22, holding pin 22 in the position shown in FIGS. 2 and 3. Additionally, with one of recesses 78 of retainer collar 38 engaged to projection 80 of holder 40, holder 40 may inhibit unintended rotation of retainer collar 38.

By projecting above top surface 94 of nose 18 into opening 36 of ground-engaging tool 10, head 32 of pin 22 may preclude ground-engaging tool 10 from sliding off of adapter 14. Any force tending to slide ground-engaging tool 10 forward (i.e., in the direction that front edge 11 of ground-engaging tool 10 faces) off of adapter 14 may drive rear surface 106 of opening 36 against surface 52 of head 32 of pin 22. Abutment of rear surface 106 of opening 36 against surface 52 may prevent further forward movement of ground-engaging tool 10 relative to adapter 14.

The forces applied to surface 52 of head 32 by rear surface 106 of opening 36 may create stresses in pin 22. For example, if left unopposed these forces could create a bending moments in pin 22 that would tend to bend head 32 forward, which could also have a tendency to pull pin 22 out of passage 34. However, the disclosed configuration of passage 34 and pin 22 provides a load path for transferring the forces on side 52 to adapter 14 in a manner that substantially reduces bending moments on head 32. Specifically, the engagement of surface 50 and shoulder 48 of head 32 against the forward surface and the shoulder 46 of outer portion 44 of passage 34 may transmit the loads on surface 52 to adapter 14 without creating substantial bending moment on head 32. This may help prevent deformation and movement of pin 22. Additionally, as noted above, configuring pin 22 with side 52 extending substantially even with the outer surface of the adjacent portion of shaft 24 may avoid stress concentrations at the junction of side 52 of head 32 and shaft 24. This may inhibit damage to pin 22 when rear surface 106 applies forward forces on side 52 and creates tensile stresses in side 52 and the adjacent portion of shaft 24. Avoiding stress concentrations between side 52 and the adjacent portion of shaft 24 may help ensure that such tensile stresses on the back side of pin 22 do not damage it.

Additionally, placing retainer collar 38 and holder 40 at the end of pin 22 opposite the end that bears retention loads may help reduce forces on retainer collar 38. When rear surface 106 of opening 36 pushes forward on head 32 of pin 22, some forces and/or moments may result at first end 28 of shaft 24 of pin 22. For example, when rear surface 106 pushes head 32 forward, this may have some tendency to push first end 28 of shaft 24 rearward as pin 22 pivots about some point in contact with the surface of passage 34, such as the surfaces of first outer portion 44 of passage 34. Retainer collar 38 and holder 40 may resist such rearward movement of first end 28 by counteracting rearward forces applied to retainer collar 38 and holder 40 by first end 28. Because retainer collar 38 and holder 40 are located at the end of pin 22 opposite head 32, there may be a relatively long moment arm from retainer collar 38 to head 32. As a result retainer collar 38 and holder 40 may only need to absorb relatively small rearward forces to prevent rearward pivoting of first end 28. Keeping these forces relatively small by providing a long moment arm between retainer collar 38 and head 32 may help reduce damage to retainer collar 38 and holder 40 during use of ground-engaging tool 10.

Furthermore, the disclosed configuration of retention system 12 may facilitate easily and inexpensively repairing retention system 12 when its retention features wear. The features of the disclosed system for retaining pin 22 reside in retainer collar 38, specifically the axial slot 68 and circumferential slot 70. Thus, when these features wear, one need only replace retainer collar 38 to repair retention system 12.

It will be apparent to those skilled in the art that various modifications and variations can be made in the disclosed systems and methods without departing from the scope of the disclosure. Other embodiments of the disclosed systems and methods will be apparent to those skilled in the art from consideration of the specification and practice of the systems and methods disclosed herein. It is intended that the specification and examples be considered as exemplary only, with a true scope of the disclosure being indicated by the following claims and their equivalents.

What is claimed is:

1. A retention system for a ground-engaging tool, the retention system comprising:

a pin, the pin including:

a shaft extending along a longitudinal axis of the pin, a plurality of radial projections extending from a first end of the shaft, and a head disposed at a second end of the shaft, the head having a non-circular axial cross-section;

a retainer collar, the retainer collar including:

an annular wall surrounding a recess configured to receive the first end of the shaft, a plurality of axial slots in an inner surface of the annular wall, the axial slots extending from a first end of the annular wall inward, the axial slots being configured to receive the radial projections, and a plurality of circumferential slots connected to the axial slots in the inner surface of the annular wall, the circumferential slots being configured to receive the radial projections of the pin; and a holder with a substantially circular recess configured to receive the retainer collar, wherein an outer surface of the annular wall of the retainer collar and an inner surface of the holder include mating detents.

2. The retention system of claim 1, wherein the mating detents include a projection on one of the retainer collar and the holder and a recess in the other of the retainer collar and the holder.

3. The retention system of claim 2, wherein the holder is made of a softer material than the retainer collar.

4. The retention system of claim 1, wherein the retainer collar includes a tool interface adjacent a second end of the annular wall.

5. The retention system of claim 4, wherein the tool interface is a recess with a substantially rectangular axial cross-section.

6. A retainer collar for a retention system of a ground-engaging tool, the retainer collar including:

an annular wall surrounding a substantially circular recess, the annular wall including a first axial end and a second axial end;

a plurality of axial slots in an inner surface of the annular wall, the axial slots extending from the first axial end of the annular wall to a point between the first and second axial ends;

a plurality of circumferential slots in the inner surface of the annular wall, the circumferential slots connecting to the axial slots;

a tool interface connected to the second axial end of the annular wall; and a first detent on an outer surface of the annular wall.

7. The retainer collar of claim 6, further comprising a second detent on an outer surface of the annular wall, the second detent being circumferentially spaced from the first detent.

8. The retainer collar of claim 7, wherein the first and second detents are recesses in the outer surface of the annular wall.

9. The retainer collar of claim 7, wherein the circumferential slot extends at least as far circumferentially around the inner surface of the annular wall as the circumferential spacing between the first and second detents.

10. The retainer collar of claim 6, wherein the first detent is a recess in the outer surface of the annular wall.

11. The retainer collar of claim 6, wherein the tool interface includes a recess with a substantially rectangular axial cross-section.

* * * * *